US007000358B2

(12) United States Patent
Clapp

(10) Patent No.: US 7,000,358 B2
(45) Date of Patent: Feb. 21, 2006

(54) SYSTEM SUPPORT ASSEMBLY

(76) Inventor: George Clapp, 9645 Diagonal Rd., Mantua, OH (US) 44255

( * ) Notice: Subject to any disclaimer, the term of this patent is extended or adjusted under 35 U.S.C. 154(b) by 247 days.

(21) Appl. No.: 10/305,903

(22) Filed: Nov. 27, 2002

(65) Prior Publication Data

US 2003/0074857 A1 Apr. 24, 2003

Related U.S. Application Data

(63) Continuation-in-part of application No. 09/999,227, filed on Nov. 27, 2001.

(60) Provisional application No. 60/253,697, filed on Nov. 27, 2000.

(51) Int. Cl.
*E04B 2/00* (2006.01)
*E04G 11/06* (2006.01)

(52) U.S. Cl. ..... 52/294; 52/426; 52/699; 52/741.13; 249/34; 249/40; 249/216

(58) Field of Classification Search ..... 52/293.1, 52/293.4, 294, 699, 309.12, 564–565, 404.1, 52/426, 404.2, 741.13, 741.15, 742.15, 742.14; 249/33–36, 40, 44–46, 21, 219.1, 216
See application file for complete search history.

(56) References Cited

U.S. PATENT DOCUMENTS 2,298,837 A * 10/1942 Oswald ..... 249/34
2,378,850 A * 6/1945 Hyre ..... 249/210
3,722,849 A * 3/1973 Luyben ..... 249/219.1
3,748,806 A * 7/1973 Talandis ..... 52/404.1

(Continued)

FOREIGN PATENT DOCUMENTS

JP 9-242086 * 9/1997

(Continued)

OTHER PUBLICATIONS

Benefits of Poly Steel brochure, by American Polysteel Forms.

(Continued)

*Primary Examiner*—Winnie Yip
(74) *Attorney, Agent, or Firm*—Brouse McDowell; Heather M. Barnes

(57) ABSTRACT

A system support assembly comprises a pair of substantially parallel footer forms, insulated concrete forms, footer form base saddles, a poly form saddle assembly and first and second vertical stabilizers. The footer form base saddle may be generally u-shaped and is driven into the ground forming two substantially parallel areas. Each footer form is placed within the row formed by the footer form base saddles such that a cavity is defined therebetween which will ultimately form the footer of the foundation. The poly form saddle assembly comprises a poly form saddle and fasteners. The poly form saddle may also be generally u-shaped and is placed over both footer forms, thus straddling the same. The poly form saddle may then be secured with corresponding fasteners. The insulated concrete forms are placed side by side and are stacked upward, such that a wall is formed. A first poly form vertical stabilizer is placed over the wall and operatively connected to the footer form base saddle. More insulated concrete forms are stacked to complete the wall. The second poly form vertical stabilizer may then be placed, preferably laterally spaced from the first poly from vertical stabilizer. The second poly form vertical stabilizer is also operatively connected to the footer form base saddle. Then, the concrete is poured into the insulated concrete forms such that the foundation wall and footers are poured and cured at one time.

14 Claims, 6 Drawing Sheets

U.S. PATENT DOCUMENTS

| | | | | | |
|---|---|---|---|---|---|
| 4,426,061 | A | * | 1/1984 | Taggart | 249/45 |
| 4,698,947 | A | * | 10/1987 | McKay | 52/309.12 |
| 4,879,855 | A | | 11/1989 | Berrenberg | |
| 4,924,641 | A | * | 5/1990 | Gibbar, Jr. | 52/204.1 |
| 5,000,621 | A | * | 3/1991 | Beamer | 405/282 |
| 5,016,885 | A | * | 5/1991 | Quigley | 473/217 |
| 5,156,753 | A | * | 10/1992 | Speidel | 249/5 |
| 5,174,083 | A | * | 12/1992 | Mussell | 52/169.1 |
| 5,207,931 | A | * | 5/1993 | Porter | 249/210 |
| 5,511,761 | A | * | 4/1996 | Schultz | 249/34 |
| 5,566,518 | A | * | 10/1996 | Martin et al. | 52/426 |
| 6,158,710 | A | * | 12/2000 | Matthews | 249/34 |
| 6,173,937 | B1 | * | 1/2001 | Cottongim | 249/40 |
| 6,591,574 | B1 | * | 7/2003 | Humphrey | 52/678 |
| 6,705,583 | B1 | * | 3/2004 | Daniels et al. | 249/34 |

FOREIGN PATENT DOCUMENTS

| | | | |
|---|---|---|---|
| JP | 11-36587 | * | 2/1999 |

OTHER PUBLICATIONS

Build It Better with Poly Steel brochure, by American Polysteel Forms.

Two Sides to Every Story brochure, by American Polysteel Forms.

Picture Yourself in Poly Steel brochure, by American Polysteel Forms.

* cited by examiner

SYSTEM SUPPORT ASSEMBLY

This continuation-in-part application claims priority from a utility application having Ser. No. 09/999,227 and filed on Nov. 27, 2001, which claims priority from a provisional patent application having Ser. No. 60/253,697, which was filed on Nov. 27, 2000. Inventorship remains the same.

BACKGROUND OF THE INVENTION

1. Field of Invention

This invention pertains to a system support assembly. More specifically, the present invention relates to the art of methods and apparatuses for securing concrete forms used during construction of foundations.

2. Description of the Related Art

In the art of constructing buildings, foundations are poured. Normally, a wood structure form is used where a contractor places wood inside and outside and a concrete split between them. Footers are poured first, which require mounting brackets, rebar and other supports ordinarily used in construction in order to put the foundation blocks on the footers and keep the foundation blocks from moving side to side. After the footers are poured and cured, the foundation walls are poured.

Currently existing in the art for foundation walls are insulated concrete forms (ICFs), which are commonly referred to as Polysteel, a registered trademark of Berrenberg Enterprises, Inc. d/b/a American Polysteel Forms of New Mexico, and described in U.S. Pat. No. 4,879,855. ICFs are comprised of two insulated side walls and are secured together with rebar. An opening is defined between the walls so that concrete can be poured therein. The ICFs are stacked like blocks and are usually secured with wood supports about the perimeter of the wall. Once the concrete is poured and cured, the ICFs stay in place, thus becoming a permanent component of the foundation.

While suited for their intended purposes, many disadvantages exist with the current system of stacking ICFs and pouring concrete therein when constructing a foundation for a structure. First, numerous supports are required about the perimeter of the foundation so that the walls do not move from side to side. Also, the footer must be poured before the wall is built with the ICFs. Further, only experienced contractors in the art of construction can successfully construct a foundation using ICFs. Traditional construction of the foundation requires proper placement of the supports around the perimeter of the foundation wall. Further, it takes an entire crew of construction workers to properly pour the concrete. Another disadvantage, which can occur when pouring concrete, is that the ICF wall may buckle due to the weight of the concrete.

Therefore, a need exists in the art for a system support assembly which provides for a monopour system, wherein the concrete for the footers and the foundation are poured at one time. Also a system is needed where only one or two people are needed to pour the foundation and footers for a structure so that labor costs are decreased. It is also desirous that the system be easy to use, such that a person with only a modicum amount of experience in construction can successfully pour a foundation and associated footers.

SUMMARY OF THE INVENTION

A system support assembly comprises a pair of substantially parallel footer forms, insulated concrete forms, footer form base saddles, a poly form saddle assembly and first and second vertical stabilizers. The footer form base saddle may be generally u-shaped and is driven into the ground forming two substantially parallel areas. Each footer form is placed within the row formed by the footer form base saddles such that a cavity is defined therebetween which will ultimately form the footer of the foundation. The poly form saddle assembly comprises a poly form saddle and fasteners. The poly form saddle may also be generally u-shaped and is placed over both footer forms, thus straddling the same. The poly form saddle may then be secured with corresponding fasteners. The insulated concrete forms are placed side by side and are stacked upward, such that a wall is formed. A first poly form vertical stabilizer is placed over the wall and operatively connected to the footer form base saddle. More insulated concrete forms are stacked to complete the wall. The second poly form vertical stabilizer may then be placed, preferably laterally spaced from the first poly from vertical stabilizer. The second poly form vertical stabilizer is also operatively connected to the footer form base saddle. Then, the concrete is poured into the insulated concrete forms such that the foundation wall and footers are poured and cured at one time.

Additional features of the system support assembly include without limitation, an extension for the footer form base saddle, a stabilizer mounting strap which operatively connects to the wall and the second poly form vertical stabilizer, a rebar suspension cradle, and a strake saddle.

Accordingly, it an object of the present invention to provide a system support assembly for securing insulated concrete forms that allows for a monopour wall so that the footers and the foundation wall are poured substantially simultaneously.

Another object of the present invention is to provide a system support assembly that remains a permanent component of the cured foundation wall and footers.

Yet another object of the present invention is to provide a system support assembly that uses less material and labor than conventional systems and methods of foundation construction.

Further, another object of the present invention is to provide a system support assembly that is a water-proof structure since the footers and foundation wall are poured substantially simultaneously.

Still yet, another object of the present invention is to provide a system support assembly that is easy to use.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
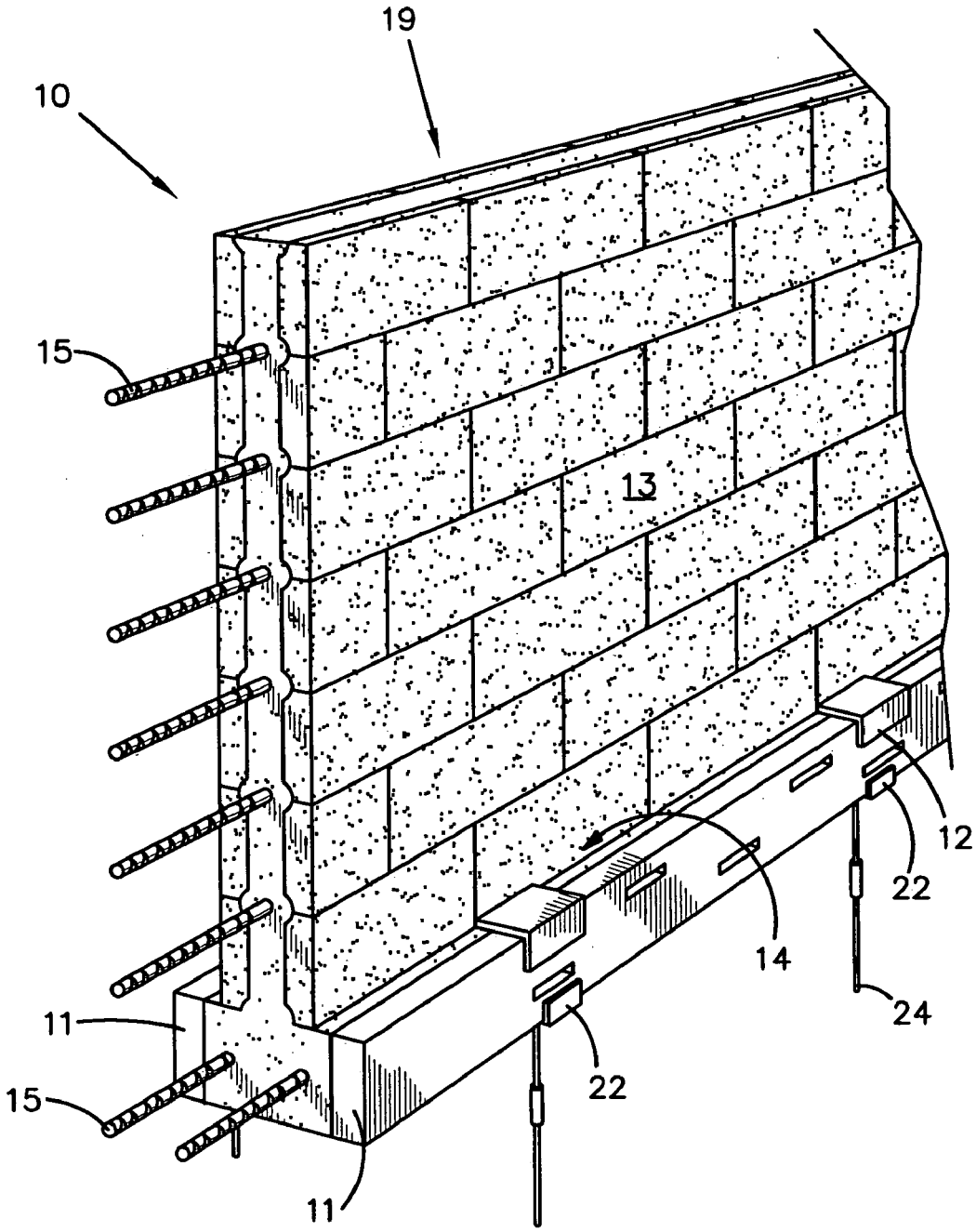
FIG. 1 is a perspective view of the present invention.
Figure 2:
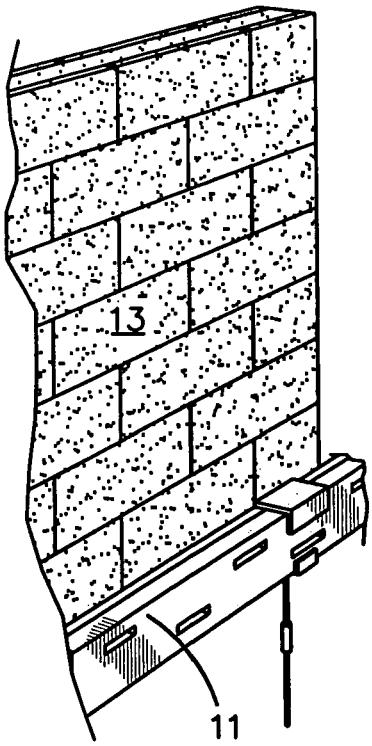
FIG. 2 is a perspective view of the present invention.
Figure 2B:
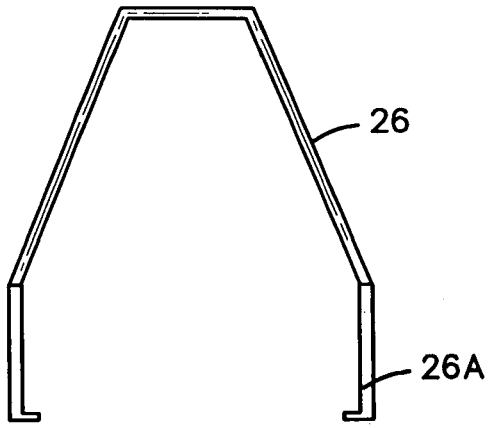
FIG. 2B is a front elevational view of a vertical stabilizer used with the present invention.
Figure 2A:
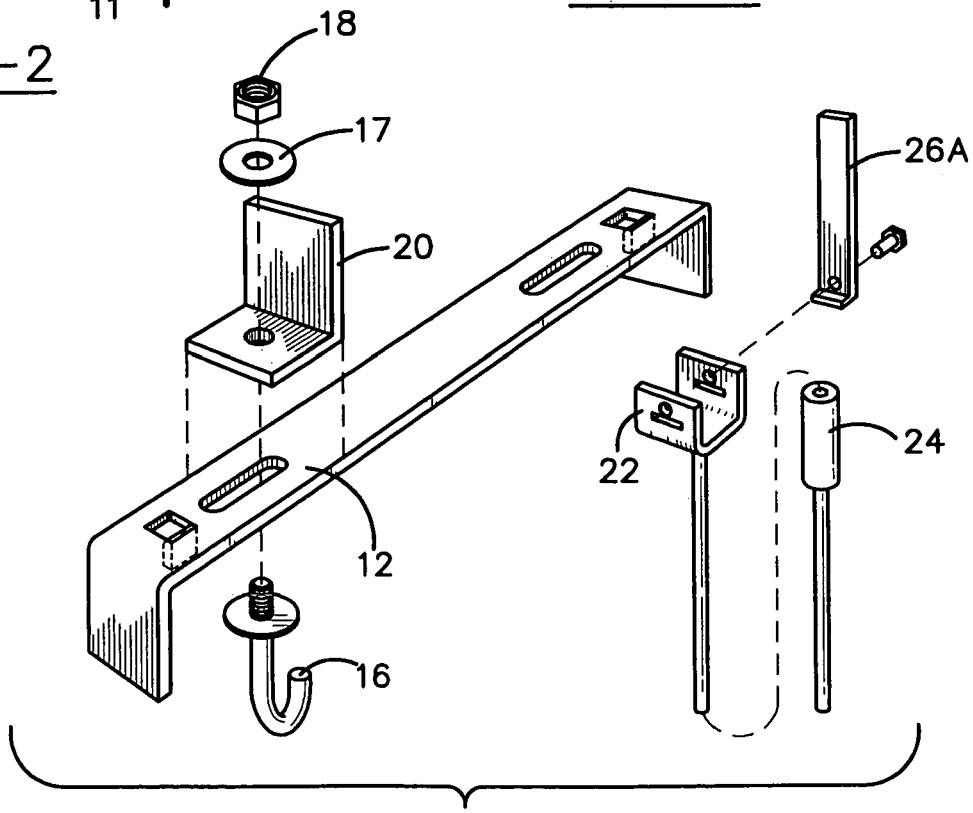
FIG. 2A is an exploded view of the present invention.
Figure 3:
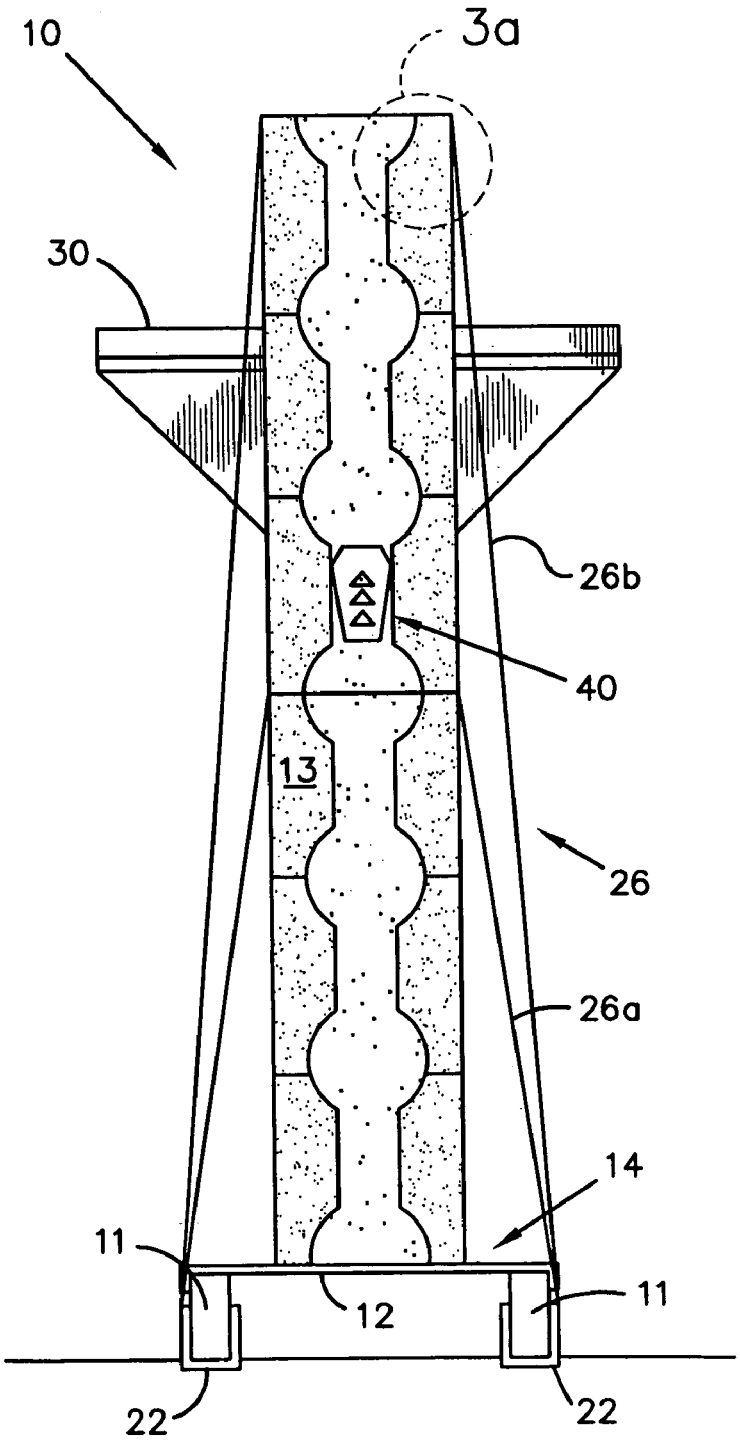
FIG. 3 is a cross sectional view of the present invention.
Figure 3A:
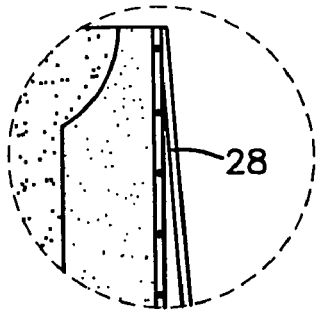
FIG. 3A is a side view of the stabilizer mounting strap.

Turning to FIGS. 1–3, a system support assembly 10 is shown. Generally, the system support assembly comprises footer means, such as a pair of footer forms 11, insulated concrete forms (ICF) 13, footer form base saddles 22, a poly form saddle assembly 14 and first and second vertical stabilizers 26*a,* 26*b*. Although, the present invention is described to be used with ICFs, any other structure utilizing block-like units may take advantage of the system support assembly 10, including without limitation, brick laying or other concrete forms. The footer form base saddle 22 may be generally u-shaped and is driven into the ground forming two substantially parallel areas. Each footer form 11 is placed within the footer form base saddles 22 such that a cavity is defined therebetween which will ultimately form the footer of the foundation. The poly form saddle assembly 14 comprises a poly form saddle 12 and fasteners 16, 17, 18. The poly form saddle 12 may also be generally u-shaped and is placed over both footer forms 11, thus straddling the same. The poly form saddle 12 may then be secured with corresponding fasteners 16, 17, 18. The ICFs 13 are placed side by side and are stacked upward, such that a wall 19 is formed. A first poly form vertical stabilizer 26a is placed over the wall 19 and secured to operatively connected to the footer form base saddle 22. More ICFs 13 are stacked to complete the wall 19. The second poly form vertical stabilizer 26*b* may then be placed, preferably laterally spaced from the first poly form vertical stabilizer 26*a*. The second poly from vertical stabilizer 26*b* is also operatively connected to the footer form base saddle 22. Then, the concrete is poured into the ICFs such that the foundation wall 19 and footers are poured and cured at one time.

With reference to FIGS. 1 and 2, the poly form saddle assembly 14 comprises the poly form saddle 12, a poly form slide bracket 20, a poly form slide bracket bolt 16, and a flat washer 17 and nut 18. The poly form saddle 12 straddles the footer forms 11 and supports the wall 19. The poly form slide bracket bolt 16 holds together the ply for the slide bracket 20, which allows the wall 19 to be moved for a more correct and true wall 19. Normally, footer forms 11 have a tendency to move approximately ½ inch to 1 inch. The slide bracket 20 allows the movement of the wall 19 so that the wall 19 can be more true. This bolt 16 fastens the poly form saddle assembly 14 together. The poly form slide bracket bolt 16 also functions as a cradle for the rebar 15 in the footer. Supporting the rebar 15 in the footer is very important during construction of the foundation because the rebar 15 cannot lay on the ground or contact the sides of the footer.

Traditionally, when a footer is poured, the footer forms are positioned and then the concrete for the footer is poured. Once the concrete begins to cure, the rebar 15 is laid on the top, and it slowly sinks. It is vital that the rebar 15 not sink to the bottom because the added strength the rebar provides would be lost. In the present invention, the footer forms 11 are positioned as is the rest of the system support assembly 10 in one building stage. Since the present invention utilizes a monopour system, the poly form slide bracket bolt 16 is needed to support the rebar 15 and prevent it from sinking to the bottom of the footer. Further, it is desirous that the poly form slide bracket bolt 16 be able to move in the slots so that perfect alignment is achieved.

With continuing reference to FIG. 2, the flat washer 17, nut 18, and the poly form slide bracket 20 form the poly form slide bracket assembly 14. Although a bracket bolt, a flat washer and nut are the preferred, any type of fasteners may be used with sound engineering judgment. The slide bracket 20 has pins in the bracket that actually penetrate the ICF 13 so that the ICF 13 cannot lift. The slide bracket 20 holds the ICF 13 against the footer, giving it stability. These are pins that go into a dolly to hold it tight.

As shown in FIG. 2, the footer form base saddle 22 is illustrated. The footer form base saddles 22 are driven into the ground for the footer forms 11 to rest in and that makes the wall 19 level. The footer form base saddles 22 are preliminarily utilized to level the wall 19. Once the footer form base saddles 22 are driven into the ground, a leveler, a laser or other similar means is used to obtain a straight line. If the ground is loose due to sand or other conditions such that the footer form base saddle 22 would sink, the extension 24 may be used. The extension 24 is attached to the rod of the footer form base saddle through a coupling means, best seen in FIG. 2. Once the extension 24 is attached to the footer form base saddle 22, the footer form base saddle 22 is driven farther down into the ground to provide the system support assembly 10 with increased stability.

The coupling means of the extension 24 has an opening on one side large enough for the rod of the footer form base saddle 22 to fit securely. This open end may be threaded or preferably, ribbed for securing the rod therein. Using the rib provides a very tight fit when the coupling means and rod are driven together. Ribbing allows for the coupling means and rod to be knolled so that when they are driven together they would be not removable. This second side of the coupling means is either welded or permanently attached to the rod of the extension, although this is not required. It is preferable to have one opening in the coupling means. The rod of the footer form base saddle 22 and the extension 24 is approximately twelve inches, although any length can be used.

FIG. 3 shows that the footer form base saddles 22 support one footer form 11, wherein the poly form saddle 12 straddles both footer forms 11 at the same time. It is preferred that that the footer form base saddles 22 be spaced apart approximately four feet. Anyone using the present invention may adjust this spacing accordingly to suit their needs.

The footer form base saddles 22 also may comprise slots. These slots are for receiving the poly form vertical stabilizer 26. In the preferred embodiment of the present invention, the poly form vertical stabilizer are in two different sizes, 48 inches and 96 inches. Once three rows of ICFs 13 are positioned, the first vertical stabilizer 26*a* may be secured. This keeps the wall 19 from moving side to side at the 48 inch elevation.

With reference to FIG. 2, pins are shown on the poly form slide bracket 20. The pins may be integral pieces of the slide bracket 20. The slide bracket 20 and pins may be constructed with a strip of steel. The pins provide strength. Since the ICFs 13 are made out of a poly like material, some crushing may occur at the bottom from the weight of the structure. The pins actually tie into the ICFs 13.

In another embodiment of the present invention, a channel is utilized, which may be constructed from light weight steel. For example, angle iron could be used instead of the pins. This would also enable the ICF 13 to rest on the channel.

With reference to FIG. 3, the stabilizer mounting strap 28 has two portions. One portion operatively connects to the ICF 13, and the second portion is slightly angled from the first and operatively connects to the poly form vertical stabilizer 26. FIG. 3 shows that the stabilizer mounting strap is generally used on the second poly form vertical stabilizer 26*b*.

The poly form vertical stabilizers 26 eliminate the ability for the ICF to pull and twist by its own compression in the wall 19, because it's knotted right into the steel. This eliminates whalers and 2×4 supports that are utilized along the perimeter of the wall. When filling the ICFs with concrete, the center section can bow in and out. The poly form vertical stabilizers 26 eliminate that bowing because of the placement of the stabilizers 26 within the poured concrete. It is preferred that the first and second vertical stabilizers 26*a,* 26*b* be laterally spaced from one another and each be placed approximately in four foot intervals about the wall 19. The interval could be lengthened to eight foot sections or even six feet or twelve feet. Any spaced interval may be used to prevent the wall 19 from buckling. Further, the poly form vertical stabilizers are preferably made of steel, namely band steel. Any light-weight material that is easy to cut may be utilized. Once the concrete has cured, the stabilizer mounting straps 28 and vertical stabilizers 26 may be removed. Thus, once the process is complete, the only clean-up required is snipping off the vertical stabilizers 26 and removing the stabilizer mounting straps 28. When working with foundation, time is a large cost factor. Moving 2×4's and restocking, getting them out, pulling nails, etc., takes a tremendous amount of time. By eliminating these supports and utilizing the present invention, clean up is quicker and easier and, thus, more cost effective.

Figure 4:
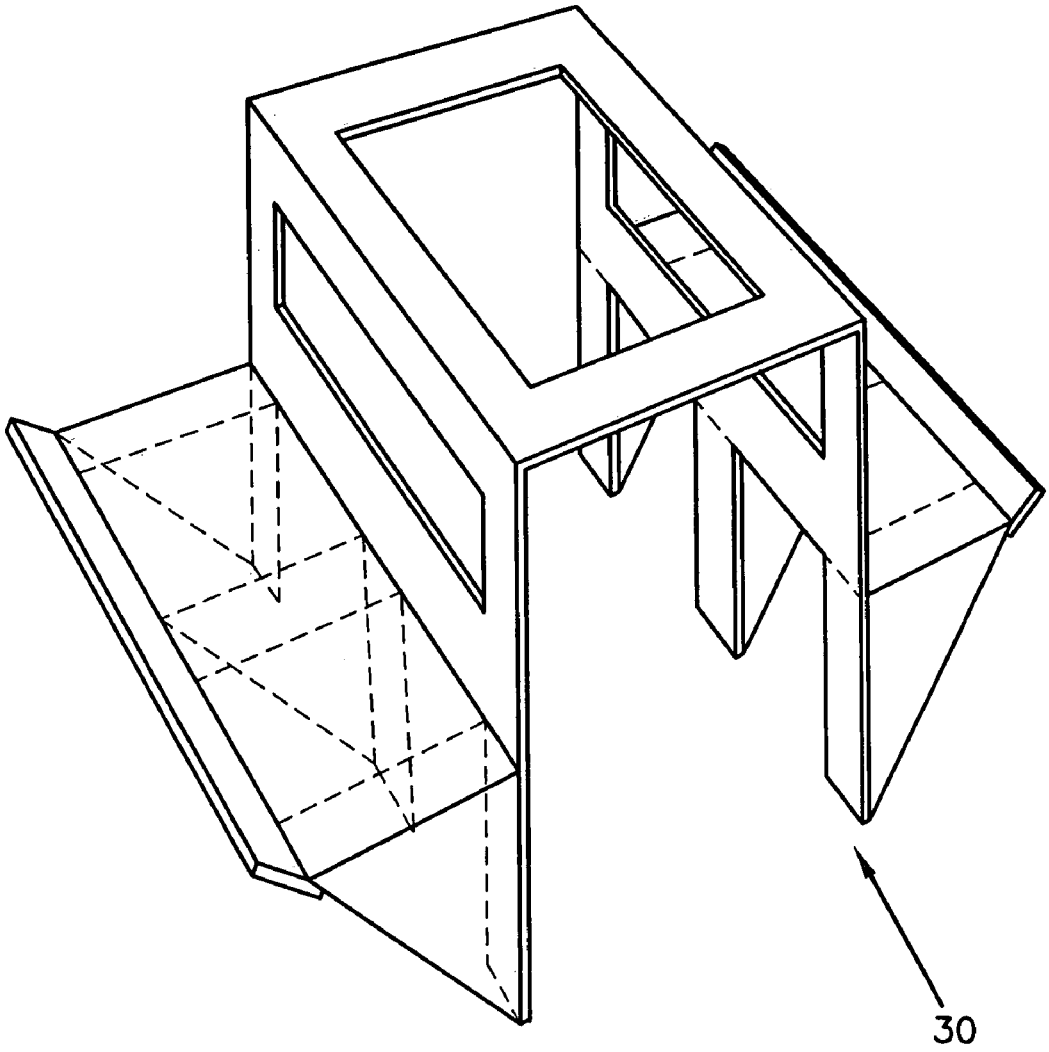
FIG. 4 is a perspective view of the strake saddle.

The present invention also may comprise a strake saddle 30, which is best seen in FIGS. 3 and 4. A strake, as used herein, is a brace or a tie that is of undescribed proportion that goes from one end of the structure to the other. For the purposes of the system support assembly 10, it allows a walker, when you are pouring concrete, to walk this board around the distance of the wall 19 to pour the concrete into this wall 19. This is advantageous because the wall is likely to be eight feet high, and a person cannot easily pour concrete over their head. This allows someone to stand on the wall 19 and to work the concrete down into the wall 19. The strake saddle 30 extends down either side of the ICF 19 approximately 9½" with a 2×10 plank to sit on it. Placement of the strake saddles 30 would be to the discretion of the workers. The planks should be 2×10's, and may be placed on either side of the strake saddle 30. Angle supports extend from the edge of the planks and secures to an ICF 13. As shown in FIG. 4, three angle supports are utilized per strake. Again, any amount of angle supports may be used. The angle supports extend approximately 12 inches from the top of the wall 19 to the ICF 13.

The strake saddle 30 may be one piece of sheet steel. Openings are formed therein to save weight and to provide an opening to poor the cement. Once the monopour is complete, the strake saddle 30 is removed by removing the boards pulling of the main body portion of the strake saddle 30.

Figure 5:
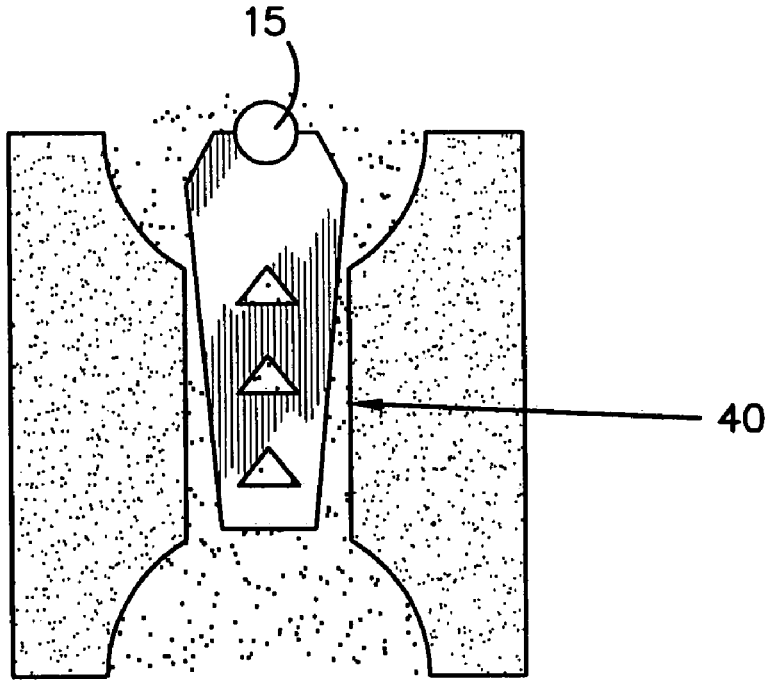
FIG. 5 is front view of the rebar suspension cradle.
Figure 6:
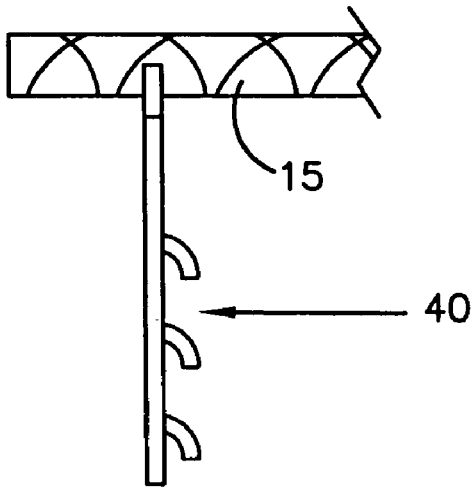
FIG. 6 is a side view of the rebar suspension cradle.

The rebar suspension cradle 40 is shown in FIGS. 5 and 6. The rebar 15 is positioned in the center of the ICF 13. The assembly currently used to build the wall 19 does not allow the rebar 15 to be suspended in the center. To suspend the rebar 15, it must be tied together. Currently, during set-up, portions of the rebar 15 protrude from the ICF 13. Two rebar need to be tied with wire. In order to keep the rebar 15 suspended, it is tied in approximately four sections at a time. However, this problem is solved with the present invention. The rebar suspension cradles may be positioned every eight feet. The rebar suspension cradle is a piece of steel, and it does not have to be heavy steel. It could be strap that is stamped out with three locking curves on it, best seen in FIG. 6. The locking curves would interlock to the framework that is already provided by the ICF 13 to allow the suspension of the rebar 15 therein. The step of tying rebar 15 together is eliminated. The rebar suspension cradle 40 is positioned at the end of each ICF, a piece of rebar 15 is placed therein, and then the next row of ICFs 13 is put in place. These cradles 40 allow the rod to be held in place during the monopour. FIG. 5 shows triangular shaped holes in the rebar suspension cradle 40. Any shape may be used that is chosen in accordance with sound engineering judgment.

To use the present invention, a suitable trench is dug for the foundation and footer. The foundation is squared corner-to-comer. Next, the poly form base saddles 22 are positioned. One line of the base saddles 22 are set. The looter form base saddles 22 are set from the center line of the ICFs 13. Once the saddle line is driven, the string (not shown) is positioned. Each saddle 22, is driven into the ground, and then each footer form 11 is installed, which is already known in the art. Of course, the extensions 24 may need to be attached to each saddle 22 if the ground is too soft.

After both sides of the footer forms 11 are installed, the poly form saddle 12 is mounted over the footer forms 11. The poly form saddle assembly 14 may be preassembled or it may be assembled as needed. The next step is to position the poly form side bracket bolt 16, flat washer 17, the nut 18, and the slide bracket 20 on the saddles 22 on one side. The rebar 15 is then cradled in the poly form slide bracket bolts 16. Two rebar for the lower quarter goes onto the bolts 16. The rebar sits on these bolts 16—one on each side of the poly form saddle 12.

Next, one row of ICFs 13 are positioned on top of the poly form saddle assembly 14. The ICFs 13 then should be aligned. Then, the line for the wall 19 is pulled to ensure the wall 19 is correctly positioned on the poly form saddle 12. The bolts 16 are tightened to secure the slide brackets 20 to the ICF 13. In summary at this juncture, one string line is set on one side of the wall 19 and the poly form saddle assembly 14 is secured to that one side. Then, one or two rows of ICFs 13 are positioned, meaning as close as possible to the tightened side. The other side of the poly form saddle assembly 14, which is loose, is slid against the ICF 13 and then tightened for a snug fit.

After both sides are secured, then a third section of ICFs 13 is positioned. Once three rows of ICFs 13 are positioned, first poly form vertical stabilizers 26*a* are installed. The first poly form vertical stabilizers 26*a* are placed over the ICFs, down to each side of the saddle 22 and received into the side slots of the saddle 22. A bolt tightens the poly form vertical stabilizers 26*a* in place.

Every time a row of ICFs are positioned, a rebar suspension cradle 40 should also be operatively connected thereto. Of course the rebar 15 could be tied instead. However, it is preferred that one rebar suspension cradle be attached to the ICFs 13 for every row of block in approximately eight foot intervals.

Additional rebar is placed within the ICFs in a downward position, i.e., going straight down in each one of the ICFs 13 as the concrete is being poured. Utilizing the present invention serves at least three purposes with regards to the rebar 15. First, as the rebar is positioned during the monopour, air is removed from the concrete. Second, as previously mentioned, it also eliminates the step of tying the rebar in suspension. Third, this additional rebar 15 adds additional structure to the ICFs 13.

As previously mentioned, once three rows of ICFs 13 are in place, the poly form vertical stabilizers 26*a* are positioned. The vertical stabilizers 26 are attached to the wall 19 through the stabilizer mounting strap 28 that goes down along the ICF 13. The mounting strap 28 should be mounted on the ICF 13 by screws, so that the vertical stabilizer 26 can be attached to it. This can be achieved in a number of ways.

One method would be to mount the stabilizer mounting strap 28 onto the ICF 13. Then, the vertical stabilizer 26*a* is placed over top of stabilizer mounting strap 28, and attach the two straps 26*a,* 28 together. The bottom side of the vertical stabilizer strap 26 is operatively connected to the saddle 22. Wall 19 construction continues with the ICFs 13, providing concrete isn't poured at that point. Although concrete can be poured at this level, it is not recommended because the rebar 15 then would be fastened into the concrete. In other words, the remaining ICFs 13 would need to be lifted over the vertically positioned rebar 15.

Once every ICF 13 section is positioned with the rebar suspension cradles 40, up to the top row of ICFs 13, which should be 96 inches, another poly form vertical stabilizer 26*b* is mounted. As previously stated, the stabilizers 26*a,* 26*b* are staggered, usually every 8 feet. In other words, in a length of a wall 19, of sixteen feet, two of the 48 inch poly form vertical stabilizers 26*a,* and two of the 96 inch poly form vertical stabilizers 26*b* would be staggered, so that one strap is suspending or holding the middle of the wall 19 while the second strap is suspending or holding the top of the wall 19.

Once the top stabilizers 26*b* are all secured to the wall 19, then the strake saddles 30 are positioned. The strake saddles 30 are positioned down over the wall and then the strake boards (2×10s) are laid. Once the strake boards are set on the saddle 30, the concrete may be poured. Of course the strake saddles 30 could be anchored through the angle supports.

Once the concrete is poured and cured, then the strake boards and strake saddle 30 are removed. The vertical stabilizers are cut and discarded. The user can save the stabilizer mounting straps 28 if he or she so desires. Finally, construction for the rest of the structure can continue.

The footer form base saddles 22 should be made out of ⅛" strap steel minimum. The vertical stabilizers 26 can be made of steel as thin as the straps they use for binding, such as those used for pallet straps. The thickness should be such that it can be cut with wire cutters, but not so thin that it will stretch. A recommended thickness could be approximately 1/16" or thinner. Further, these vertical stabilizers 26 could be approximately one inch in width. The bolts, may be ⅜" bolts minimum.

The pins on the rods of the footer saddles 22 should be about ½" or any size which would permit their expansion into the earth and out far enough that they have structure to them and so they cannot move readily back and forth. And, of course, the bushing, or the coupling that puts the two of those together would be the ⅛ inch wall thickness.

Figure 7:
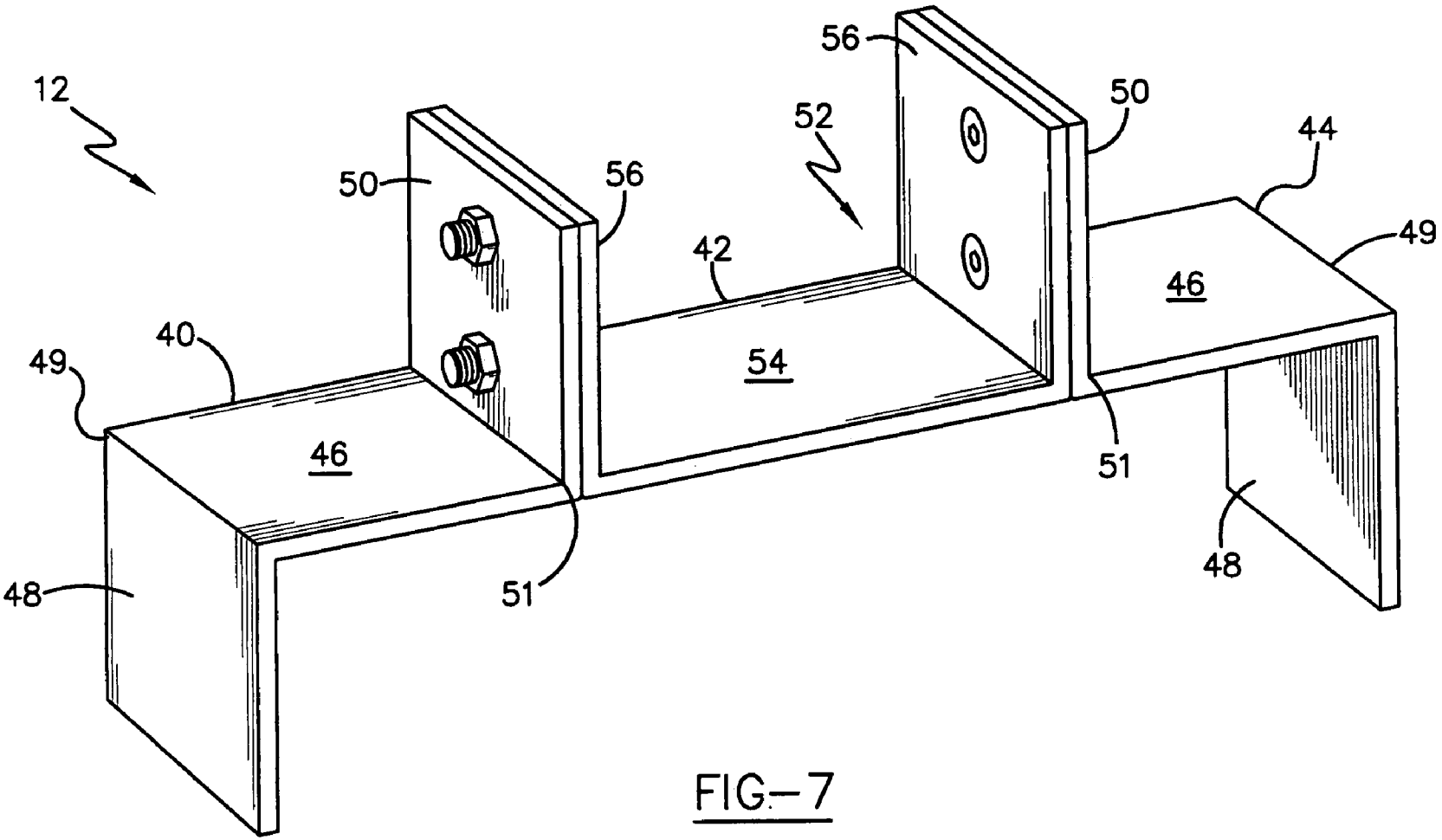
FIG. 7 is a perspective view of another embodiment of the poly-form saddle.

With reference to FIG. 7, another embodiment of the poly form saddle 12' is shown. As in the previous embodiment, the poly form saddle 12' straddles the footer forms 11 and aids in the support of the ICFs 13. However, in this embodiment, portions of the poly form saddle 12' are separable. After the concrete has cured, the separable portion may be removed, if desired, so that they may be reused at a later time. Because portions of the poly form saddle 12' may be reused, this embodiment has great economic advantages, namely, cost savings in materials.

The poly form saddle 12' comprises three separable sections 40, 42, 44. The first and third sections 40, 44 each have a center section 46, which is substantially horizontal. The first and third sections 40, 44 further comprise one downwardly extending leg 48 extending from a first end 49 and upwardly extending leg 50 extending from a second end 51. The downwardly extending legs 48 and upwardly extending legs 50 form substantially ninety degree angles with the center section 46. Further, the downwardly extending legs 48 contact the footer forms 11, while the upwardly extending legs contact the second section 42 of the poly form saddle 12'.

With continuing reference to FIG. 7, the second section 42 is a u-shaped bracket 52 having a base 54 and two upwardly extending legs 56. The upwardly extending legs 56 of the u-shaped bracket 52 contact and support the ICFs 13. As shown in FIG. 7, the upwardly extending legs 56 of the u-shaped bracket and the upwardly extending legs 50 of the first and third section 40, 44 are fastened together through nuts and bolts. Of course, the first, second, and third sections 40, 42, 44 may be joined together in any manner chosen in accordance with sound engineering judgment provided that the first and third sections 40, 44 may be removed from the second section 42 after the concrete has cured.

In operation, the steps previously described are undertaken. After the concrete is cured, the first and third sections 40, 44 of the poly form saddle 12' are removed. The second section 42 remains part of the foundation structure. To reuse the first and third section 40, 44, the upwardly extending legs are operatively connected to the legs of the second section 42, as shown in FIG. 7. The poly form saddle 12' can then be positioned as previously described.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. An apparatus, comprising: footer means;

at least one isolated concrete form operatively associated with said footer means, said footer means and said isolated concrete form being adapted to simultaneously receive concrete;

a poly form saddle, said poly form saddle adapted to support said footer means;

a slide bracket operatively connected to said footer means, said slide bracket attaching to at least one isolated concrete form;

a base saddle including a support member adapted to support said footer means; and, a rod operatively connected to said support member, said rod adapted to be positioned into an associated underlying surface;

wherein said poly form saddle comprises:

a first section;

a second section; and, a third section, the first and third sections be operatively connected to the second section, the first, second and third section adapted to straddle said footer means, and at least one of the sections being removable after associated concrete has cured.

2. The apparatus of claim 1, wherein the second section is a u-shaped bracket having a base and two legs extending upwardly therefrom.

3. The apparatus of claim 1, wherein the second section is adapted to support the isolated concrete form.

4. The apparatus of claim 1, wherein the first section comprises:

a substantially horizontal section with first and second ends;

a downwardly extending leg extending from the first end; and, an upwardly extending leg extending from the second end.

5. The apparatus of claim 1, wherein the third section comprises:

a substantially horizontal section with first and second ends;

a downwardly extending leg extending from the first end; and, an upwardly extending leg extending from the second end.

6. The apparatus of claim 1, wherein the first section is removable from the second section after the associated concrete has cured.

7. The apparatus of claim 1, wherein the third section is removable from the second section after the associate concrete has cured.

8. The apparatus of claim 1, wherein the first and third sections are operatively connected to the second sections through at least one bolt and nut.

9. The apparatus of claim 1, wherein, the first and third sections each comprise:

a substantially horizontal section with first and second ends;

a downwardly extending leg extending from the first end; and, an upwardly extending leg extending from the second end;

wherein the second section is a u-shaped bracket having a base and two legs extending upwardly therefrom, such that the upwardly extending legs of the first and third sections operatively connect to the legs of the u-shaped bracket, the first and third sections being removable from the u-shaped bracket.

10. A method for securing concrete forms to pour a foundation, comprising the steps of:

providing footer means, a plurality of saddles, and a plurality of insulated concrete forms, each of said plurality of saddles having at least one elongated opening defined therein, each of the saddles having a first, second, and third section wherein the first and third sections are operatively connected to the second section;

positioning the footer means;

securing one side of each of the plurality of saddles to the footer means;

securing the first section of said saddle to the second section of said saddle with a slide bracket bolt, the slide bracket bolt having a hooked end;

positioning rebar on the hooked end of the slide bracket bolt;

positioning one row of insulated concrete forms on the plurality of saddles;

tightening each of the slide bracket bolts to secure the first section of the saddles to one of the plurality of concrete forms;

positioning a second row of insulated concrete forms on top of the first row of insulated concrete forms;

securing the second section of the saddle against at least one of the insulated concrete forms;

pouring concrete into the plurality of insulated concrete forms, wherein the footer and the foundation wall are simultaneously formed; and, removing the first section of the saddle after the concrete cures.

11. The method of claim 10, further comprising the step of:

installing a first vertical stabilizer over the plurality of insulated concrete forms, when said insulated concrete forms reach a first predetermined height; and, securing the first vertical stabilizer to the saddle.

12. The method of claim 10, further comprising the step of:

installing a rebar suspension cradle to one of the insulated concrete forms at a predetermined interval.

13. The method of claim 10, further comprising the steps of:

installing a second vertical stabilizer over the plurality of insulated concrete forms when said insulated concrete forms reach a second predetermined height; and, securing the second vertical stabilizer to the saddle.

14. The method of claim 10, further comprising the step of removing the third section of the saddle after the concrete has cured.

* * * * *